United States Patent [19]

Gilcher

[11] Patent Number: 4,535,959

[45] Date of Patent: Aug. 20, 1985

[54] VITAL SOLID STATE RELAY FOR RAILROAD ALTERNATING CURRENT TRACK CIRCUITS

[75] Inventor: Heinz Gilcher, Export, Pa.

[73] Assignee: American Standard Inc., Swissvale, Pa.

[21] Appl. No.: 404,182

[22] Filed: Aug. 2, 1982

[51] Int. Cl.[3] ..... B61L 21/00; B61L 25/00

[52] U.S. Cl. ..... 246/34 R; 246/122 R; 324/87

[58] Field of Search ..... 246/34 R, 34 CT, 34 D, 246/122 R; 324/87

[56] References Cited

U.S. PATENT DOCUMENTS

| | | | |
|---|---|---|---|
| 4,188,002 | 2/1980 | Gilcher | 246/34 R |
| 4,258,312 | 3/1981 | Gilcher | 246/34 D |
| 4,298,179 | 11/1981 | Gilcher | 246/34 R |
| 4,407,470 | 10/1983 | Gilcher | 246/34 R |

FOREIGN PATENT DOCUMENTS

| | | | |
|---|---|---|---|
| 652702 | 3/1979 | U.S.S.R. | 246/34 R |
| 882806 | 11/1981 | U.S.S.R. | 246/34 R |

*Primary Examiner*—James J. Groody
*Attorney, Agent, or Firm*—A. G. Williamson, Jr.

[57] ABSTRACT

This vital solid state relay incorporates only passive elements and is intended for use as a replacement for a two element AC track relay in AC track circuits. The local input signal is applied to a transformer whose secondary output, across a Zener diode, is a pulsed, square wave DC with regulated peak. The track input is applied through a noise rejection filter, tuned to track circuit frequency, to a coupling transformer. A series loop registry circuit includes the secondary of each transformer, a DC relay, and a varistor element. The sum of the transformer output signals, due to the Zener diode rectification, has a DC component. When local and track signals are both present and substantially in phase, the varistor switches to its high current condition to pick up the DC relay to indicate an unoccupied track section. Absence of the track input, out of phase conditions, or unmatched frequencies retains the varistor in its low current state and the DC relay releases to register an occupied section.

7 Claims, 3 Drawing Figures

VITAL SOLID STATE RELAY FOR RAILROAD ALTERNATING CURRENT TRACK CIRCUITS

FIELD OF THE INVENTION

My invention pertains to solid state relay apparatus for use as a track relay in alternating current railroad track circuits. More particularly, the invention provides a passive solid state arrangement to replace the vane type track relay in alternating current track circuits on direct current electrified railroads.

BACKGROUND OF THE INVENTION

The use of the so-called chopper apparatus in train propulsion systems on direct current (DC) electrified railroads tends to create interference with the operation of the alternating current (AC) track circuits, with vane type AC track relays, used for train detection. Such induced interference is of a nature to cause the track relay to pick up with a train occupying the track section. Obviously this creates a dangerous condition, i.e., an indication of an unoccupied section with a train actually present. Vane type relays are not easily and cheaply made immune to such interference. Rather, a desirable solution to the problem is a solid state circuit arrangement, with a simple DC register relay, which may be substituted for the vane relay but is more immune to interfering currents induced in the rails by the train propulsion apparatus.

Accordingly, an object of my invention is a solid state relay arrangement which can be used as an alternating current track relay in railroad track circuits.

Another object of the invention is a vital solid state relay arrangement to replace a vane type AC relay to replace a vane type AC relay in an AC railroad track circuit.

A further object of the invention is a solid state AC relay with two inputs and a summing network, for combining the inputs, including in series a DC relay which is energized for registering the presence of both inputs when they have a phase relationship within selected limits.

Yet another object of my invention is a solid state arrangement, to be substituted for the vane relay in an AC track circuit, in which half wave rectified local input, produced and voltage limited by a Zener diode, is combined with the AC track circuit input in a series circuit which includes a varistor switching element and a DC relay to register the track circuit input when in phase with the local input and of at least a predetermined level.

A still further object of the invention is an AC track circuit for a railroad track section, including a two input solid state track relay, and with an AC source supplying track energy to the rails at one end of the section and, at the other end, local energy for the solid state relay arrangement through a coupling transformer whose secondary is connected across a Zener diode, which half-wave rectifies and regulates the DC pulses to a predetermined peak level, the received track energy being applied, through a noise rejection filter, to another coupling transformer having a third loading winding comprising a single shorted turn, both transformer secondary outputs being added in a series circuit including a varistor switching element and a DC relay which registers the presence of the track signal only when in phase with the local signal and of sufficient level.

Other objects, features, and advantages of my invention will become apparent from the following specification when taken in connection with the accompanying drawings and appended claims.

SUMMARY OF THE INVENTION

In the specifically shown context of use as a track relay, the solid state relay arrangement of the invention has a first input from the local track energy source coupled through an isolating transformer. The secondary output voltage is applied to a Zener diode for half-wave rectification and regulation. The resulting local source signal is thus substantially a pulsed square wave direct current with a predetermined peak. The track input signal, received through the rails from the same source, is applied through a series tuned LC noise rejection filter to the primary of a coupling transformer. The secondary provides an output level required by an inner relay circuit to register an unoccupied track indication. The inner circuit is a series connection of the Zener diode in multiple with the local input transformer secondary, the track input transformer secondary, the winding of a DC register relay, and a varistor element. An instrument type fuse is also included to protect the varistor which acts as a switching device. With only the local input present, the voltage applied in the loop circuit is insufficient to switch the varistor to a high current condition and the register relay remains released. Only if the track input through the filter and transformer is at least at the selected level, and is in phase with the local input signal, is the applied voltage sufficient to switch the varistor to pass a high current so that the DC relay picks up to register an unoccupied track section.

BRIEF DESCRIPTION OF THE DRAWINGS

Prior to defining the invention in the appended claims, I will describe a specific example of the solid state relay arrangement and an example of its use, as illustrated in the accompanying drawings, in which:

In each of the drawing figures, similar reference characters designate the same or similar parts of the apparatus of signals.

DESCRIPTION OF THE ILLUSTRATED EMBODIMENT

Figure 1:
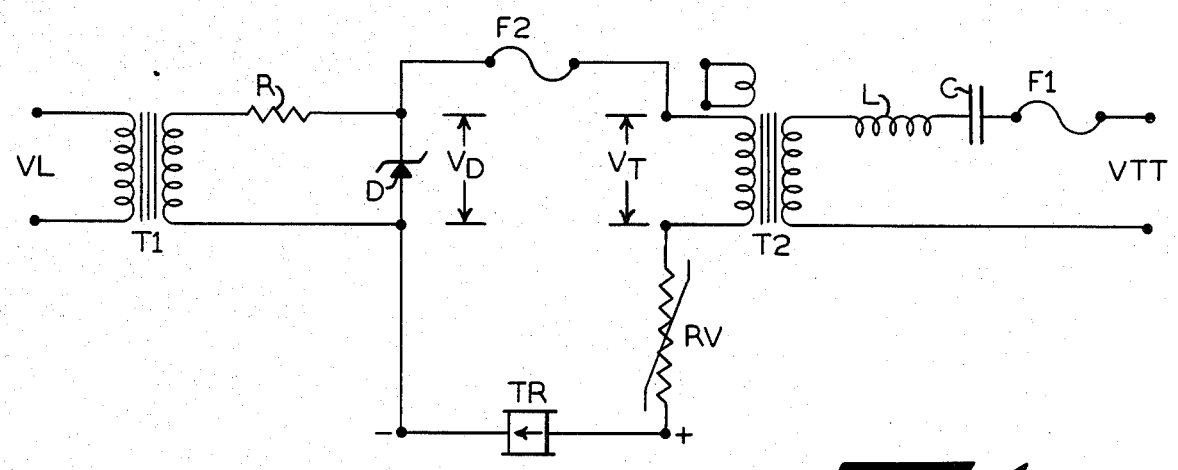
FIG. 1 is a schematic circuit diagram of a solid state relay embodying the features of my invention.
Figure 2:
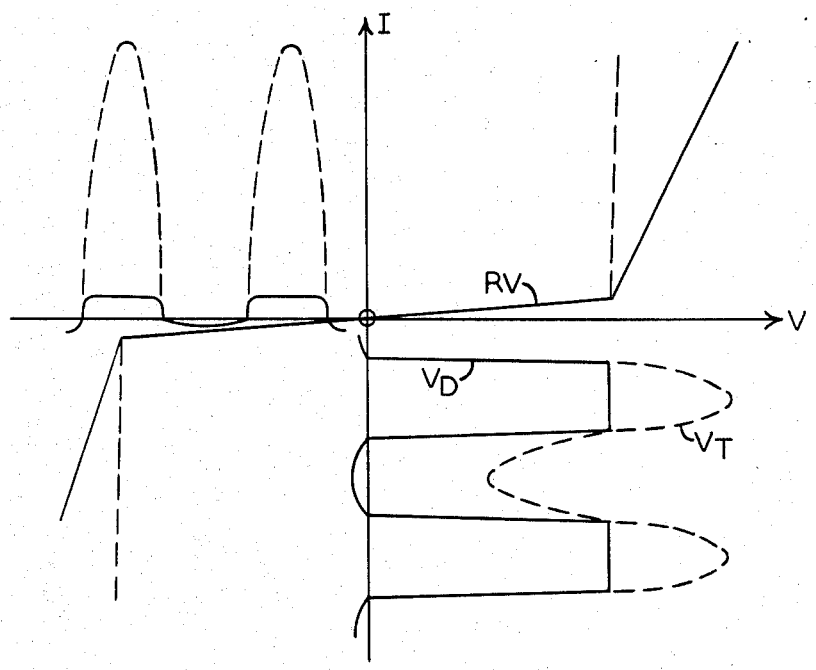
FIG. 2 is a chart showing typical voltage and current relationships for the arrangement of FIG. 1.
Figure 3:
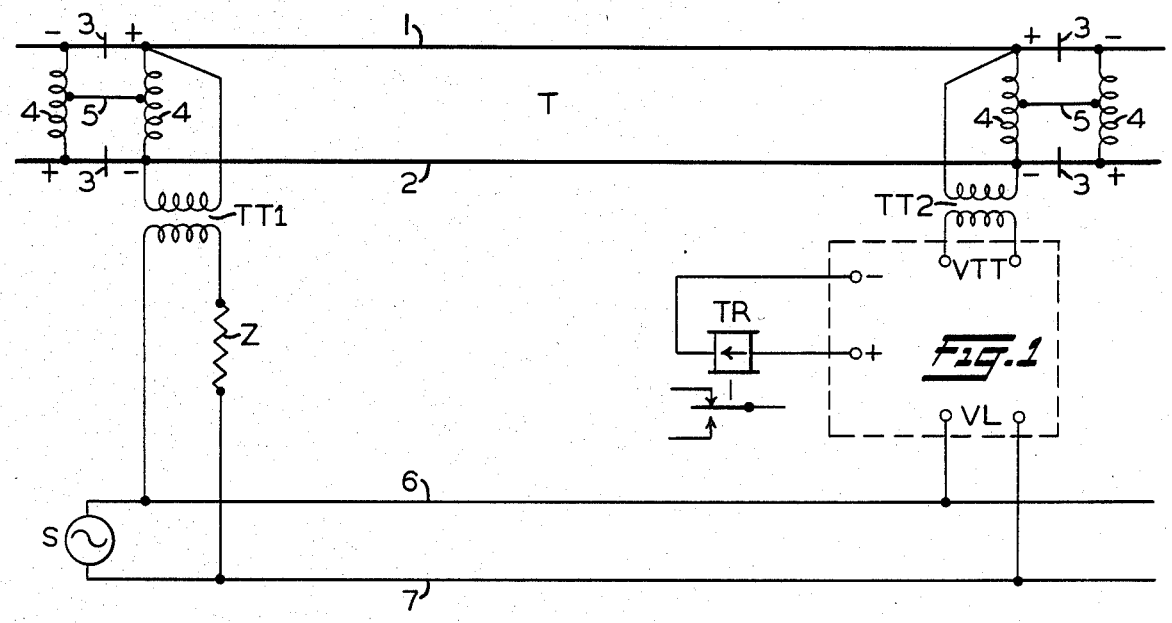
FIG. 3 is a schematic diagram of a railroad track circuit employing the relay arrangement of FIG. 1.

Referring to FIG. 1, the solid state relay arrangement shown is assumed to be used as the track relay in an AC track circuit, as will be more fully explained in FIG. 3. The local source of track circuit AC energy is connected to the primary of transformer T1 at the input terminals VL. This track circuit energy source may have, for example, a frequency on the order of 50–60 Hz although the invention is not limited to this range. Transformer T1 provided electrical isolation and a voltage level adjustment to provide the relay circuit requirements. A resistor R and a Zener diode D are connected across the transformer secondary in series as shown. The resulting output signal $V_D$, across diode D, is then an amplitude limited or regulated series of substantially square wave DC pulses as illustrated by the solid line wave form or curve $V_D$ in FIG. 2.

The track input signal from the rails is applied at terminals VTT, through a step-up track transformer if needed. This input is connected to the primary of coupling transformer T2 through a noise rejection filter illustrated as a series LC circuit with inductor L and capacitor C. In other words, the filter is tuned to the track source frequency to block propulsion power harmonics and other induced frequencies. A fuse F1 protects against current surges from the rails. The secondary output signal $V_T$ of transformer T2 is, by design, at a level to satisfy the relay circuit energy requirements. Transformer T2 has a third winding consisting of a single turn, which is short circuited for loading, as will be discussed.

The inner loop or relay circuit includes, connected in series, the secondaries of transformers T1 and T2, an instrument fuse F2, a varistor element RV, and the winding of a biased DC relay TR. The varistor RV acts in the usual manner as a threshold or switching device. If only the local signal is present, at terminals VL, the DC current pulses through relay TR, resulting from the voltage pulses $V_D$ across diode D, are very low as illustrated by the solid line waveform in the upper left quadrant of the graph of FIG. 2. When a track input signal of proper amplitude and phase, i.e., 0° phase angle between track and local signals, is applied at input VTT, the voltage output of transformer T2, illustrated by the dash line curve $V_T$ in FIG. 2, adds to the voltage pulses $V_D$. The resulting DC current pulses, illustrated by the dash line wave forms in the upper left, have sufficient DC component to pick up and hold up relay TR. A track input signal which is out of phase with the local signal will cause an attenuated relay current depending upon the phase difference. Obviously, the maximum attenuation occurs with a 180° phase difference.

This operation results from the VI operating characteristics of the varistor element RV in the relay circuit, whose typical resistance pattern is illustrated by the straight line RV in the FIG. 2 chart. When only the local signal input is applied, i.e., the pulses $V_D$, the varistor functions in the central, high resistance portion of its operating curve, i.e., the solid line of shallow slope, where relatively large variations in voltage V result in small changes in current (I) flow. Beyond this range, the varistor exhibits very low resistance so that current increase is almost infinite with only little voltage variation, as shown by the almost vertical dash line portion of curve RV. The moderating effect of resistance of other elements in the series circuit holds the rate of current I to the slope of the solid line.

A typical use of the relay arrangement of FIG. 1 in a track circuit is shown in FIG. 3. Referring now to this drawing figure, a track section T of a stretch of electrified railroad is shown with its rails 1 and 2 illustrated by conventional single line symbols. The rails of section T are electrically insulated from the rails of the adjoining sections by the insulated joints 3, also illustratd by conventional symbols. In order to provide a return circuit for the propulsion current, impedance bond windings 4 are connected across rails 1 and 2 at each end of section T and the associated ends of the adjoining sections. The center taps of each associated pair of bond windings 4 are connected by a lead 5 to provide a conventional circuit path through section T for propulsion current. It is here assumed that direct current propulsion power is used.

The signaling system for this stretch of railroad is based on continuous train detection using a track circuit for each track section such as section T. Signaling energy for the track circuits is provided from a central source S shown conventionally at lower left, having a frequency, for example, of 50 to 60 Hz, and is distributed along the stretch of railroad by the line wires 6 and 7. Energy is supplied across the rails of section T at the left or transmitting end through a track transformer TT1 from the line circuit 6, 7. Even though AC energy is used, the supply connections are such that the instantaneous polarity of the rails on each side of insulated joints are opposite, as indicated by the polarity markings at the rails. The supply connections include a selected resistor Z which limits the current flow when a train shunts the rails at the transmitting end. Track transformer TT1 may be incorporated as part of the impedance bond but it is normally preferable to have a separate transformer, as shown. At the other or receiving end of section T, the solid state relay circuit arrangement of FIG. 1 is connected across the rails and to the line circuit. This relay is illustrated by a dashed block with input terminals and output terminals designated by the same references as in FIG. 1. In other words, terminals VL are connected across line circuit 6, 7 and terminals VTT, through track transformer TT2, across rails 1 and 2 at the impedance bond connections. Track relay TR, of the same biased type previously illustrated, is connected across terminals + and − with proper polarity direction.

In considering the operation of this track circuit, it is to be remembered that the vital circuit network shown in FIG. 1, when connected within the track circuit of FIG. 3, acts as a two element, alternating current track relay device. The track circuit is adjusted under minimum ballast conditions (wet weather and low ballast resistance) so that the track and local signal currents are in phase at the receiver end. Under these conditions, track current is near the minimum level required to pick up relay TR. With no train shunt or broken rail in section T, the VL and VTT signals are both present. The resulting signals $V_D$ and $V_T$ add in phase (FIG. 2) so that the varistor functions at the low resistance portion of its VI curve (upper right quadrant) and sufficient DC current flows to pick up relay TR to indicate section T unoccupied. When a train occupies section T and creates a shunt between the rails, signal VTT is absent and signal VL alone produces insufficient output energy to shift varistor RV away from the high resistance, flat part of the curve, so that relay TR releases to register an occupied track condition.

In the operation of the track circuits using this solid state relay, the DC traction voltages and harmonics of the AC source of the DC propulsion power are attenuated by the track input filter network. The shorted turn (third winding) on transformer T2 (see FIG. 1) provides loading in order to swamp out the nonlinear influence of the varistor element. This relay circuit is vital since the DC relay TR will not respond to AC signals even though the signal level is considerably larger than the normal DC input. If Zener diode D shorts out, the local signal level will go to zero and the relay will remain in its released position. If the Zener diode open circuits, a large AC current results and again the relay remains in the released position since it picks up only in response to DC energizing current. Failure of filter elements L or C will result in a decreased track input level and decreased track circuit sensitivity. To protect the vitality of varistor RV, a high quality instrument fuse is provided. Vitality and reliability are also enhanced because no active solid stage elements are used. The solid state relay arrangement is thus vital, efficient, and economic.

Although I have herein shown and described only one specific arrangement of the solid state relay embodying the invention, it is to be understood that various changes and modifications therein within the scope of the appended claims may be made without departing from the spirit and scope of my invention.

Having thus described the invention, what I claim as new and desire to secure by Letters Patent, is:

1. A vital solid state relay arrangement comprising,
(a) first input means coupled for receiving a first alternating current signal from a first source having a selected signal frequency,
(b) a second input means coupled for at times receiving a second alternating current signal from a second source, said second signal having said selected frequency and a predetermined phase relationship with said first signal,
(c) a varistor element,
(d) a register means normally occupying a first position and operable to a second position,
(e) a register network coupling said first and second input means, said varistor element, and said register means for operating said register means to its second position to register the presence of said second signal only when both signals are present and within said predetermind phase relationship,
(f) a first transformer coupled to said first source for producing a selected level first signal at its secondary winding output, and
(g) a Zener diode having a preselected regulating level connected across said first transformer secondary winding, and
(h) the multiple path circuit through said secondary winding and said diode coupled for supplying rectified square wave pulses with peaks at said preselected regulating level into said register network.

2. A solid state relay arrangement as defined in claim 1 in which said second input means comprises,
(a) a filter network turned to said selected frequency,
(b) a second transformer coupled by said filter network to said second source and responsive to a second signal of said selected frequency for producing an alternating current signal on its secondary winding, and
(c) said second transformer secondary winding coupled for supplying said selected frequency signal into said register network to enable operation of said register means to its second position.

3. A solid state relay arrangement as defined in claim 2 in which,
(a) said second source is one end of a transmission channel of known length coupled to said first source at the other end,
(b) the presence or absence of said second signal represents first and second conditions of said channel to be registered, and,
(c) said register means is operable to its first and second positions to register said second and first conditions of said channel, respectively.

4. A solid state relay arrangement as defined in claim 3 in which, said register means is a direct current relay connected in series in said register network with said transformer secondary windings and said varistor element, normally occupying a deenergized first position and responsive only to pulsating current of the direction established by said Zener diode and of a level representing the presence of both input signals for operating to an energized second position.

5. A solid state relay arrangement as defined in claim 4 in which,
(a) said transmission channel comprises the rails of a railroad track section, said first and second conditions being said section unoccupied and occupied by a train, respectively,
(b) said direct current relay in its deenergized position registering an occupied section and an unoccupied section in its energized position.

6. A track circuit arrangement for an insulated railroad track section, with propulsion power currents having varying characteristics flowing in the rails, comprising,
(a) a source of alternating current energy of preselected frequency coupled to said rails at one end of said section,
(b) a register relay normally occupying a first position and operable to a second position to indicate said section unoccupied by a train,
(c) a control circuit network, including a varistor switch element, coupled for energizing said register relay,
(d) a first input means coupled to said source for supplying a pulsed direct current square wave signal with a regulated peak voltage to said control circuit network,
(e) a second input means coupled to said rails at the other end of said section for supplying an alternating current signal from said source to said control circuit network when the section is unoccupied by a train,
(f) said control circuit network responsive to both input signals for energizing said register relay to operate to its second position only when both signals are present and in phase.

7. A track circuit arrangement as defined in claim 6 in which,
(a) said first input means includes a first transformer having its primary winding connected to said source and a Zener diode, with a breakdown voltage equal to said regulated peak voltage, connected across its secondary winding,
(b) said second input means includes a filter network tuned to said preselected frequency, and a second transformer with its primary winding connected in series with said filter network across the rails at said other end of said section,
(c) both secondary windings are connected in series with said varistor element and said register relay in said control circuit network for supplying energy having a direct current component to said register relay,
(d) said register relay is operated to its second position by the applied energy only when both signals are present, have the same frequency, and are in phase.

* * * * *